United States Patent [19]

Ricketts

[11] 4,262,965

[45] Apr. 21, 1981

[54] TRIANGULAR BLASTING INTO LIMITED VOIDS FOR VERTICAL FREE FACE RETORTS

[75] Inventor: Thomas E. Ricketts, Grand Junction, Colo.

[73] Assignee: Occidental Oil Shale, Inc., Grand Junction, Colo.

[21] Appl. No.: 78,040

[22] Filed: Sep. 24, 1979

[51] Int. Cl.[3] ..... E21C 41/10

[52] U.S. Cl. ..... 299/2; 102/23; 299/13

[58] Field of Search ..... 299/2, 13; 166/259; 102/23

[56] References Cited

U.S. PATENT DOCUMENTS

| | | | |
|---|---|---|---|
| 4,043,595 | 8/1977 | French | 299/2 |
| 4,043,596 | 8/1977 | Ridley | 299/2 |

*Primary Examiner*—Ernest R. Purser

*Attorney, Agent, or Firm*—Christie, Parker & Hale

[57] ABSTRACT

Oil shale formation is explosively expanded toward a limited void volume for forming an in situ oil shale retort in a subterranean formation containing oil shale. In one embodiment, the retort is formed by excavating a narrow vertical slot diagonally across a retort site of rectangular horizontal cross-section, leaving separate triangular zones of unfragmented formation within the retort site on opposite sides of the diagonal slot. Explosive is placed in a plurality of vertical blasting holes drilled in each triangular zone of formation, and such explosive is detonated for explosively expanding formation within the triangular zones toward vertical free faces adjacent the slot for forming a fragmented permeable mass of formation particles containing oil shale. Detonation of explosive in the blasting holes expands separate wedge-shaped segments of formation toward the diagonal slot, owing to the natural cratering effect of each blast, causing the wedge-shaped segments being expanded to conform generally to the side boundaries of each triangular zone, and producing reasonably good fragmentation and movement of expanded formation toward the slot from formation throughout the retort site. Several such slots can be employed in forming a retort.

42 Claims, 7 Drawing Figures

TRIANGULAR BLASTING INTO LIMITED VOIDS FOR VERTICAL FREE FACE RETORTS

BACKGROUND OF THE INVENTION

This invention relates to in situ recovery of shale oil, and more particularly, to techniques involving excavation of a void and explosive expansion of oil shale formation toward such a void in preparation for forming an in situ oil shale retort.

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits have been described in several patents, such as U.S. Pat. Nos. 3,661,423; 4,043,595; 4,034,596; 4,034,597; 4,034,598; and 4,118,071, which are incorporated herein by this reference. These patents describe in situ recovery of liquid and gaseous hydrocarbon materials from a subterranean formation containing oil shale, wherein such formation is explosively expanded for forming a stationary, fragmented permeable mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbon products, and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

It is desirable to form a fragmented mass having a distribution of void fraction suitable for in situ oil shale retorting; that is, a fragmented mass through which oxygen-supplying gas can flow relatively uniformly during retorting operations. Techniques used for explosively expanding formation toward the void space in a retort site can affect the permeability of the fragmented mass. Bypassing portions of the fragmented mass by retorting gas can be avoided in a fragmented mass having reasonably uniform permeability in horizontal planes across the fragmented mass. Gas channeling through the fragmented mass can occur when there is non-uniform permeability.

A fragmented mass of reasonably uniform void fraction distribution can provide a reasonably uniform pressure drop through the entire fragmented mass. When forming a fragmented mass, it is important that formation within the retort site be fragmented and displaced, rather than simply fractured, in order to create a fragmented mass of generally high permeability; otherwise, too much pressure differential is required to pass a retorting gas through the retort. Preferably the retort contains a reasonably uniformly fragmented mass of particles so uniform conversion of kerogen to liquid and gaseous products occurs during retorting. A wide distribution of particle size can adversely affect the efficiency of retorting because small particles can be completely retorted long before the core of large particles is completely retorted.

The general art of blasting rock formation is discussed in *The Blaster's Handbook,* 15th Edition, published by E. I. DuPont de Nemours & Company, Wilmington, Del.

The prior art has disclosed techniques for forming a fragmented permeable mass of particles in an in situ oil shale retort, wherein formation from within a retort site is excavated to form a void in the form of a narrow slot having vertically extending free faces. Blasting holes can be drilled parallel to the vertical free faces in rectangular zones of formation adjacent opposite sides of the slot. Explosive is placed in the blasting holes and detonated in a desired time delay sequence for explosively expanding formation in such rectangular zones toward the free faces for forming the fragmented mass. Explosive within the retort site can be detonated for expanding separate vertical segments of formation from within the retort site toward the free faces in a time delay sequence progressing into such formation away from the free faces. In such a blasting pattern there is progressively less void space into which vertical segments of formation of the same size can be expanded. Stated another way, the segments of formation farthest from the free face encounter increasing confinement when blasting progresses into the formation away from the free face. In some instances such confinement can inhibit desired breakage and movement of formation being expanded.

Moreover, explosive placed in a rectangular zone of formation and blasted toward rectangular void volumes can create an inefficient use of explosive energy along the side boundaries of the zone being blasted. The natural cratering effect of explosive when detonated causes fragmentation of formation to occur in an outwardly diverging pattern from the explosive charge. Fragmentation from such explosive expansion can be askew to the desired rectangular side boundaries of the retort being formed, resulting in an inefficient use of explosive along the boundaries.

It would be beneficial to provide a blasting pattern in which the cross-sectional shape of formation being expanded can reasonably match the side boundaries of the retort being formed, so that use of explosive energy is reasonably efficient. It would also be beneficial to provide a blasting pattern in which oil shale formation expanded toward a vertical free face has reasonably good lateral relief throughout the retort site as expansion progresses into the retort site away from the free face, to provide reasonably good breakage and movement of formation being expanded.

SUMMARY OF THE INVENTION

One embodiment of the present invention provides a method for forming an in situ oil shale retort within side boundaries of a retort site in a subterranean formation containing oil shale. The retort contains a fragmented permeable mass of formation particles containing oil shale. Explosive charges are placed in a generally triangular shaped zone of formation bounded on two sides by the side boundaries of the retort being formed and bounded on a third side by a generally vertical free face of formation adjacent a void excavated in formation within the retort site. The explosive charges are detonated for explosively expanding portions of the generally triangular-shaped zone of formation toward the vertical free face for forming a fragmented permeable mass of formation particles containing oil shale in an in situ oil shale retort.

The in situ oil shale retort being formed can be generally rectangular in horizontal cross-section, and at least one slot-shaped void can be excavated diagonally across the horizontal cross-section of the rectangular-shaped retort site, leaving separate generally triangular-shaped zones of unfragmented formation remaining within the retort site adjacent opposite vertical free faces adjacent the void. Formation can be explosively expanded from within each triangular-shaped zone of formation toward respective vertical free faces adjacent the slot for forming a fragmented mass of particles in the in situ retort.

DRAWINGS

These and other aspects of the invention will be more fully understood by referring to the following detailed description and the accompanying drawings, wherein.

DETAILED DESCRIPTION

Figure 1:
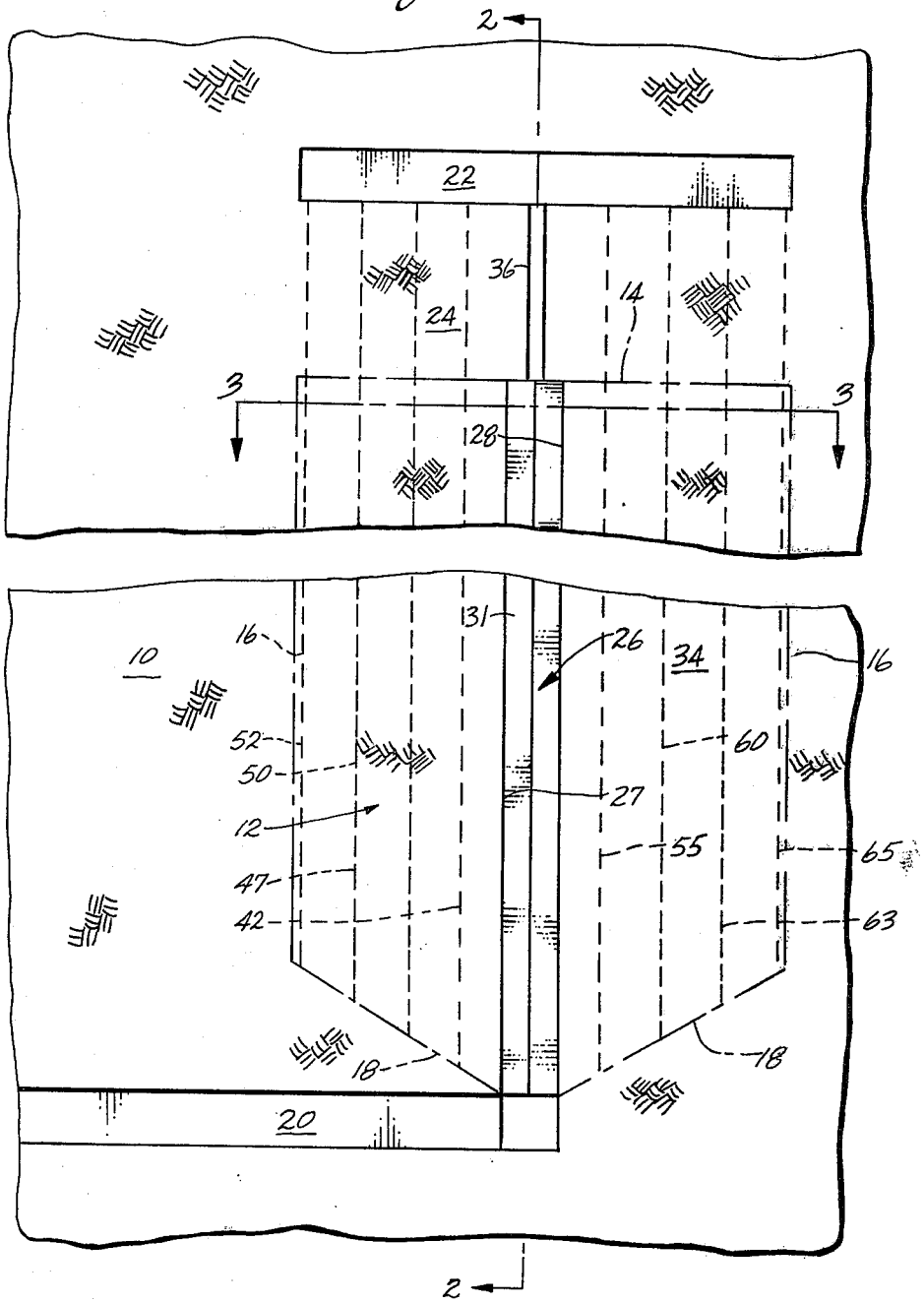
FIG. 1 is a fragmentary, semi-schematic vertical cross-section taken on line 1—1 of FIG. 3 and showing an in situ oil shale retort having a diagonally extending slot-shaped void.
Figure 2:
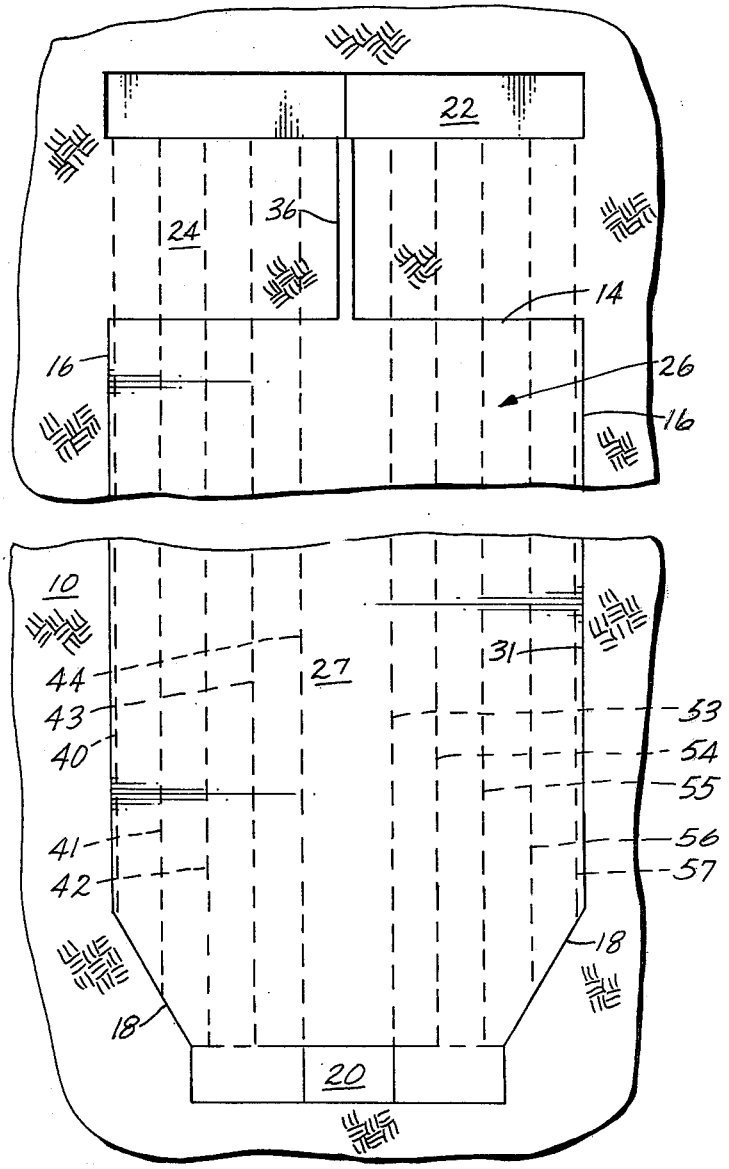
FIG. 2 is a fragmentary, semi-schematic vertical cross-section taken on line 2—2 of FIG. 3.

FIGS. 1 and 2 are vertical cross-sections showing a subterranean formation 10 containing oil shale in which an in situ oil shale retort is being formed in a retort site 12 within the formation. The in situ retort being formed is rectangular or square in horizontal cross-section, as shown best in the top plan view of FIG. 3. The vertical cross-sections of FIGS. 1 and 2 are taken along orthogonal vertical planes extending diagonally across the rectangular cross-section of the retort site. As shown in phantom lines in FIGS. 1 and 3 the retort being formed has a top boundary 14, four vertically extending side boundaries 16, and a downwardly and inwardly tapering lower boundary 18. A lower level drift 20 at a production level provides a means for access to the lower boundary of the in situ oil shale retort. Formation excavated to form the drift is transported to above-ground through an adit or a shaft (not shown).

In preparation for forming the in situ oil shale retort in an exemplary embodiment, formation is excavated from above the retort site to form an open base of operation 22 on an upper working level. The floor of the base of operation is spaced above the upper boundary 14 of the retort being formed, leaving a horizontal sill pillar 24 of unfragmented formation between the bottom of the base of operation and the upper boundary of the retort being formed. The horizontal extent of the base of operation is sufficient to provide effective access to substantially the entire horizontal cross-section of the retort site. Such a base of operation provides an upper level means for access for excavating operations for forming a void within the retort site. The base of operation also provides means for access for explosive loading for explosive expansion of formation toward such a void to form a fragmented permeable mass of formation particles in the retort being formed. The base of operation also facilitates introduction of oxygen-supplying gas into the top of the fragmented mass formed below the horizontal sill pillar. Pillars of unfragmented formation can be left within the upper base of operation to provide roof support for formation overlying the base of operation. Such roof-supporting pillars are not shown in the drawings for simplicity.

The in situ oil shale retort is prepared by excavating a portion of formation from within the retort site for forming at least one void. In the embodiment illustrated in the drawings, the void is in the form of a narrow, elongated vertically extending slot-shaped void 26, herein referred to as a vertical slot. The vertical slot extends diagonally across the horizontal cross-section of the retort site. In the illustrated embodiment the length of the slot extends essentially the entire distance from one corner of the retort diagonally across the center of the retort to an opposite corner of the retort.

The corners of the retort are formed at the junctures of the vertical side boundaries 16 at opposite sides of the retort being formed. The height of the vertical slot extends from the top boundary 14 of the retort being formed downwardly to the production level drift 20 at the bottom center of the retort. The opposite long side walls of unfragmented formation adjacent the slot provide parallel first and second free faces 27 and 28 of formation extending vertically and diagonally through the retort site. Shorter end walls 30 and 31 are formed at opposite ends of the slot adjacent the corners of the retort site.

Figure 3:
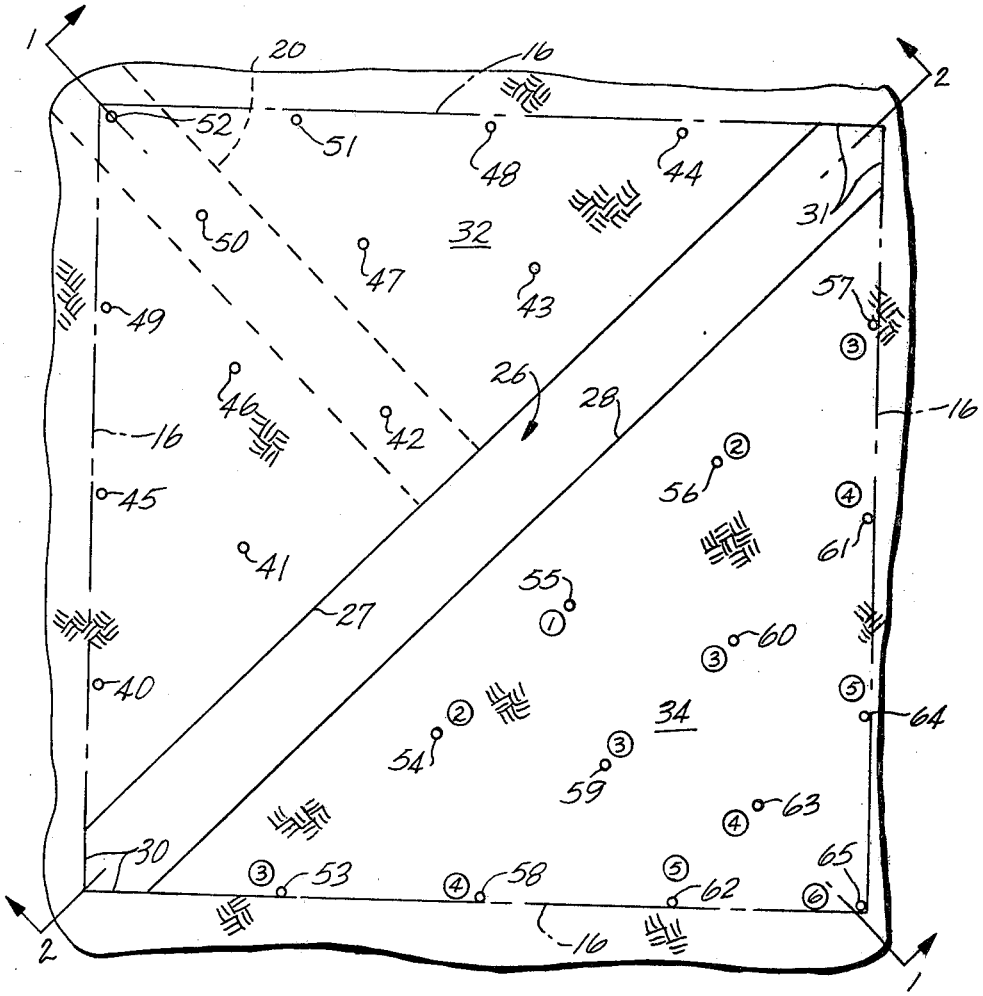
FIG. 3 is a fragmentary, semi-schematic horizontal cross-section taken on line 3—3 of FIG. 1.

As best illustrated in FIG. 3, the retort being formed in this example is square in horizontal cross-section, and the diagonal slot extends across the center of the retort site, leaving within the retort site a first zone 32 of unfragmented formation, which is triangular in horizontal cross-section, adjacent the first vertical free face 27 adjacent the slot; and leaving within the retort site a second zone 34 of unfragmented formation, which is also triangular in horizontal cross-section, adjacent the second vertical free face 28 adjacent the slot. Since the retort site is square in horizontal cross-section and is divided equally by the diagonal slot, each triangular zone is shaped as an isoscoles triangle (actually a triangular prism), with the base of the triangle being the vertical free face adjacent the slot, and with the two triangles being equal to one another in area.

Since the lower side boundaries 18 of the retort being formed taper downwardly and inwardly toward the drift 20 at the bottom of the retort, the end walls of the slot at the bottom of the retort site (see FIG. 2) are generally coextensive with a portion of the tapering lower side boundaries of the retort being formed.

In one embodiment of the retort shown in FIGS. 1 through 3, the slot can occupy desirably between about 20% to 35% of the volume of formation within the retort being formed. To determine the desired width W of the slot for forming a fragmented mass of desired void fraction VF, wherein the retort has side boundaries of length L, the equation for slot width is:

$$W = \sqrt{2}\, L\,[1 - \sqrt{1 - VF}\,]$$

For example, In an embodiment wherein the length of each side boundary of a square retort is 75 feet, and the desired void fraction is 23%, the width of the slot is 13 feet.

FIGS. 1 and 2 show the upper portion of a vertical raise 36 initially bored through the retort site and subsequently used for forming the vertical slot. Techniques for forming the slot are described in the aforementioned U.S. Pat. No. 4,118,071.

The triangular zones of unfragmented formation adjacent opposite sides of the slot are explosively expanded toward the vertical free faces 27 and 28 adjacent the slot for forming a fragmented permeable mass 38 (FIG. 7) of formation particles containing oil shale in the in situ oil shale retort. The unfragmented formation within the retort site is explosively expanded into a limited void volume provided by the vertical slot. A test has been made in which formation containing oil shale was explosively expanded toward a vertical free face by means of explosive in a vertically extending blasting hole wherein the volume into which the formation could expand was effectively unlimited. That is, the extent of expansion of the fragmented mass was not limited by confinement by adjacent formation so that the resultant fragmented mass did not completely fill the available void space. It was found that the formation "bulked" about 55%; that is, the total volume of the fragmented mass was about 55% greater than the volume of formation fragmented to form the fragmented mass. This corresponds to an average void fraction in the fragmented mass of about 35%. Thus, free expansion of oil shale formation by such a technique requires a void volume of at least about 35% of the volume of formation explosively expanded.

By "limited void volume" is meant that the volume of the vertical slot is smaller than the volume required for free expansion of oil shale formation toward the slot. The volume of the slot is preferably less than about 35% of the volume of the fragmented mass being formed, the most preferred range being about 20% to 25%. That is, the volume of the void is less than about 35% of the volume of the void plus the unfragmented formation to be explosively expanded towards the void. The blasting pattern and techniques described below facilitate expansion of oil shale formation toward a vertical free face of limited void volume for forming a fragmented permeable mass of particles suitable for in situ retorting of oil shale.

Following formation of the diagonal slot 26, a plurality of mutually spaced apart blasting holes are drilled downwardly from the base of operation 22 through the first and second triangular zones 32, 34 of unfragmented formation remaining within the retort site on opposite sides of the diagonal slot. The blasting holes extend from the floor of the base of operation of the lower boundary of the retort being formed. The blasting holes can be arranged, as shown in FIG. 3, in separate mutually spaced apart rows extending generally parallel to the vertical free faces adjacent the slot. The pattern of blasting holes on one side of the slot is similar to the pattern of blasting holes on the other side of the slot. In the exemplary arrangement shown in FIG. 3, there is a first row of five blasting holes 40 through 44 respectively, drilled downwardly through the first zone 32 of unfragmented formation adjacent to and parallel to the first free face 27 adjacent the slot; a second row of four blasting holes 45 through 48, respectively, drilled downwardly through the first zone parallel to the first row on a side thereof opposite the slot; a third row of three blasting holes 49 through 51, respectively, extending parallel to the second row on a side thereof opposite the slot; and a single blasting hole 52 at the corner of the retort site farthest from the free face. The blasting hole in each row are approximately equidistantly spaced apart from one another. The blasting holes 40, 45, and 49 in the first three rows extend adjacent to and parallel to one vertical side boundary 16 of the first zone 32 of formation, and blasting holes 44, 48, and 51 in the first, second and third rows, respectively, extend adjacent to and parallel to the other vertical side boundary 16 of the first zone 32 of formation.

Similarly, a first row of five blasting holes 53, 54, 55, 56, and 57, respectively, is drilled downwardly through the second zone of unfragmented formation adjacent to and parallel to the second free face 28 of the slot; a second row of four blasting holes 58, 59, 60 and 61, respectively, is drilled downwardly in the second zone 34 parallel to the first row on a side thereof opposite the slot; a third row of three vertical blasting holes 62, 63, 64, respectively, is drilled on a side of the second row opposite the slot; and a single blasting hole 65 is drilled at the corner of the retort side farthest from the slot. The blasting holes 53, 58 and 62 are drilled adjacent to and parallel to one side boundary 16 of the second zone, and the blasting holes 57, 61 and 64 are drilled adjacent to and parallel to the other vertical side boundary 16 of the second zone 34.

The blasting holes in each row in the first and second zones are approximately equidistantly spaced apart. Further, the burden distance of the blasting holes in each row on one side of the slot is substantially the same as the burden distance of the blasting holes in each corresponding row on the opposite side of the slot.

The blasting holes on opposite sides of the slot are loaded with explosive up to a level corresponding to a top boundary of the retort being formed. The upper portions of the blasting holes which extend through the sill pillar are loaded with an inert stemming material such as sand or gravel. Explosive in the blasting holes is detonated in a single round of explosions, i.e., in a single series of explosions with time delays of fractions of a second between explosions. Time intervals in the order of about one millisecond per foot of spacing between holes is satisfactory. Detonation of explosive in the blasting holes explosively expands formation toward the first and second vertical free faces adjacent the slot forming the fragmented mass 38 (see FIG. 7) within the boundaries of the in situ retort site. Detonation of explosive for forming the fragmented mass leaves a sill pillar of unfragmented formation between the top of the fragmented mass and the floor of the upper base of operation.

Although described in this exemplary embodiment with a horizontal sill pillar of unfragmented formation left between the top of the fragmented mass and the overlying base of operation, it will be understood that variations can be practiced. Thus, for example, blasting holes can be loaded with explosive charges to a level sufficient to also explosively expand formation towards an overlying base of operation. Such explosive expansion can be in the same round as expansion towards the vertical slot, or can be in a subsequent round. Similarly, the retort can be formed without an overlying subterranean base of operation, with blasting holes drilled from the ground surface.

In one embodiment, the explosive is detonated in a time delay sequence starting in one or more blasting holes nearest the center of each row and progressing outwardly in opposite directions toward the ends of each row. The time delay sequence of blasting also progresses in a direction away from the slot, starting in the row immediately adjacent the free face and progressing away from the free face toward the corner of the retort farthest from the free face. In the exemplary embodiment, explosive in at least some of the blasting holes in the first row is detonated before explosive in at least some of the blasting holes in the second row is detonated and explosive in at least some of the blasting holes in the second row is detonated before explosive in at least some of the blasting holes in the third row is detonated, and so on.

FIG. 3 illustrates such an exemplary time delay sequence in which the order of firing explosive charges in the second zone 34 of formation is indicated by the numerals in circles adjacent corresponding blasting holes. Referring to the example illustrated in FIG. 3, detonation of the explosive in the blasting hole 55 at the center of the first row in initiated first, followed by explosive in the blasting holes 54 and 56 in the first row on opposite sides of the middle blasting hole 55, thereafter followed by explosive in the blasting holes 53 and 57 at the ends of the first row. Substantially simultaneously with detonation of explosive in the blasting holes at the ends of the front row, explosive in the blasting holes 59 and 60 in the middle of the second row, is detonated, and so on, as indicated in FIG. 3.

In the exemplary embodiment, explosive in each row of blasting holes in the first zone of formation can be detonated in the same order as the order in which the explosive in the second zone of formation is detonated. Blasting holes in each row of the first zone correspond to similarly located blasting holes in the second zone. Explosive in each pair of corresponding blasting holes on opposite sides of the slot can be detonated substantially simultaneously; or alternatively, there can be a short time delay between detonation of explosive in corresponding pairs of blasting holes on opposite sides of the slot. The delay, if any, should be short enough that insufficient expansion of formation adjacent one face of the slot has occurred to yield substantial asymmetry in void fraction distribution; that is, the void fraction is preferably reasonably uniform throughout the fragmented mass.

The time delay sequence of blasting in the exemplary embodiment of FIG. 3 provides a V-cutting method of explosively expanding formation toward the slot, in which generally V-shaped segments of formation are blasted toward the slot from nearer the center of the triangular zones of formation shortly before blasting adjacent segments from nearer the boundaries of the zones.

Alternatively, explosive in the blasting holes of FIG. 3 can be detonated in rows progressing away from the slot, but without time delays between explosive detonations in each row.

The time delays indicated in the example of FIG. 3 are provided by commerically available explosive delay devices for producing time delays of a fraction of a second between initiation of explosive in successive blasting holes, e.g., in the order of about 25 milliseconds between successive delay devices. Some variation in the actual timing can occur dur to random deviation from the stated values and small superimposed time delays from detonating cord used to initiate the delay devices. These variations do not significantly alter the sequences described herein.

Referring again to the exemplary blasting pattern illustrated in FIG. 3, the time delay sequence of detonations continually creates new free faces, and formation subsequently is expanded toward the new free faces formed by previously detonating explosive in adjacent blasting holes. Such progressive blasting toward newly created free faces enhances uniform fragmentation of formation toward the slot. Detonation of explosive in the blasting holes produces a cratering effect in which outwardly diverging, generally wedge-shaped segments of formation are expanded away from the blasting holes toward the free faces.

The blasting pattern illustrated in FIG. 3 can enhance reasonably uniform fragmentation of formation expanded toward the slot. For example, in a system for expanding a generally rectangular zone of formation toward a vertical free face or slot having less than unlimited void volume, progressively more confinement can be encountered by segments of formation being expanded toward the slot as the direction of blasting progresses away from the free face toward the side boundaries of the retort site. Such confinement can cause wedging of formation and reduced expansion of formation at the outer regions of the retort site, compared with less confinement and more highly expanded formation adjacent the slot. Moreover, explosive placed in generally rectangular arrays of blasting holes in a rectangular zone of formation expanded toward a vertical free face can result in inefficient use of such explosive along the side walls of the retort site. Since the natural cratering (triangular) shape of formation being expanded in segments along the side boundaries of such a retort site is not naturally coextensive with the desired rectangular side boundaries of such a retort site, the result can be inefficient use of explosive in blasting holes along the side boundaries of the retort site.

The blasting pattern illustrated in FIG. 3 takes advantage of the natural cratering effect produced by detonation of explosive in the blasting holes extending parallel to the free face. Since a generally triangular zone of unfragmented formation is expanded toward the diagonal slot, detonation of explosive in blasting holes along the side boundaries of the retort site can expand wedge-shaped segments of formation that are generally aligned with the side boundaries of the retort site. Since the shape of the zone of formation being expanded is close to that of a natural crater shape, i.e., the width of the zone becomes progressively narrower away from the free face, resulting fragmentation of the zone is reasonably efficient because the explosive charges can interact to move formation in the crater-like shape toward the free face, instead of inhibiting reasonably uniform expansion. Further, the explosive charges located farthest from the free face have less formation to move into the diminishing void and in addition have good lateral relief that helps to not confine or limit breakage or freedom of movement of such formation as it is expanded toward the slot.

In one exemplary embodiment of a 75 foot square retort site in which there are 13 blasting holes per zone of formation adjacent the slot, arranged as shown in FIG. 3, the blasting holes can be six inches in diameter, and each blasting hole can be loaded with aluminized ammonium nitrate-fuel oil (ANFO) explosive. The scaled depth of burial of all explosive charges is substantially the same, and in the exemplary embodiment the scaled depth of burial can be 8.4 mm/cal$^{1/3}$. The scaled depth of burial of an explosive charge is the measure of the ability of the explosive charge or array of charges to explosively expand formation and can be expressed in units of distance over weight or preferably energy, of explosive to the one-third power ($d/w^{1/3}$). The distance, referred to as the burden distance, in the equation for scaled depth of burial is measured from the free face to the effective centroid of the explosive. The weight or energy is the total for the charge of explosive. In the exemplary embodiment the aluminized ANFO has a density of 1.1 g/cc and an explosive energy of 1180 cal/gm, and the weight of the explosive is about A13.5 pounds per foot of blasting hole. This provides a powder factor (PF) of 1.5 pounds of ANFO per ton of burden being expanded.

The spacing between blasting holes can differ from the illustrated embodiment, in which case the burden distance is changed to compensate for the change in spacing, i.e., for fixed hole diameters, larger burden distances are used with reduced spacing between the explosive charges, and vice versa. The spacing between blasting holes and the burden distance can be adjusted, but in each case it is desirable for the product of spacing and burden distance to satisfy the equation: $S \cdot B = 150$ ft$^2$ for six inch diameter blasting holes loaded with aluminized ANFO where S and B are spacing and burden distances, respectfully. This provides a blast design with a scaled depth of burial of 8.4 mm/cal$^{1/3}$. The spacing should not exceed about 3/2 the burden to insure good charge interaction and continuous breakage of the entire layer of shale. In one embodiment using six-inch diameter blasting holes, the holes in each row can be spaced 12¼ feet apart with 12¼ feet of burden, i.e., spacing equals burden.

In an alternative embodiment using eight-inch diameter blasting holes and eight of such blasting holes arranged in a triangular zone of formation in rows of 4, 3, and 1 blasting hole(s) per row progressing away from the free face of a diagonal slot, and using aluminized ANFO as the explosive blasted at a scaled depth of burial of 8.4 mm/cal$^{1/3}$, the product $S \cdot B = 266$ ft$^2$. In this example, a desirable spacing between blasting holes can be about 16.3 feet with a burden distance of about 16.3 feet, for the case of spacing being equal to burden.

In the above examples where the spacing equals the burden distance, the scaled depth of burial of a row of charges is equal to the scaled depth of burial of each individual charge, and this represents an optimum efficient use of explosive and provides most uniform fragmentation.

As a further alternative embodiment, each triangular zone of formation can be explosively expanded toward a diagonal slot in lifts, i.e., in generally horizontal layers of formation in a time delay sequence progressing from the bottom of the retort site toward the top of the retort site. Such explosive expansion in lifts can be in a single round of explosions, or in a separate lift technique with long delay periods between blasting each lift to provide at least enough time to place explosive in the next lift after the prior lift is blasted. Each lift in such a sequence would be blasted with delays such as those illustrated in FIG. 3 within the lift and a further delay between the end of one lift and the commencement of the next.

Figure 4:
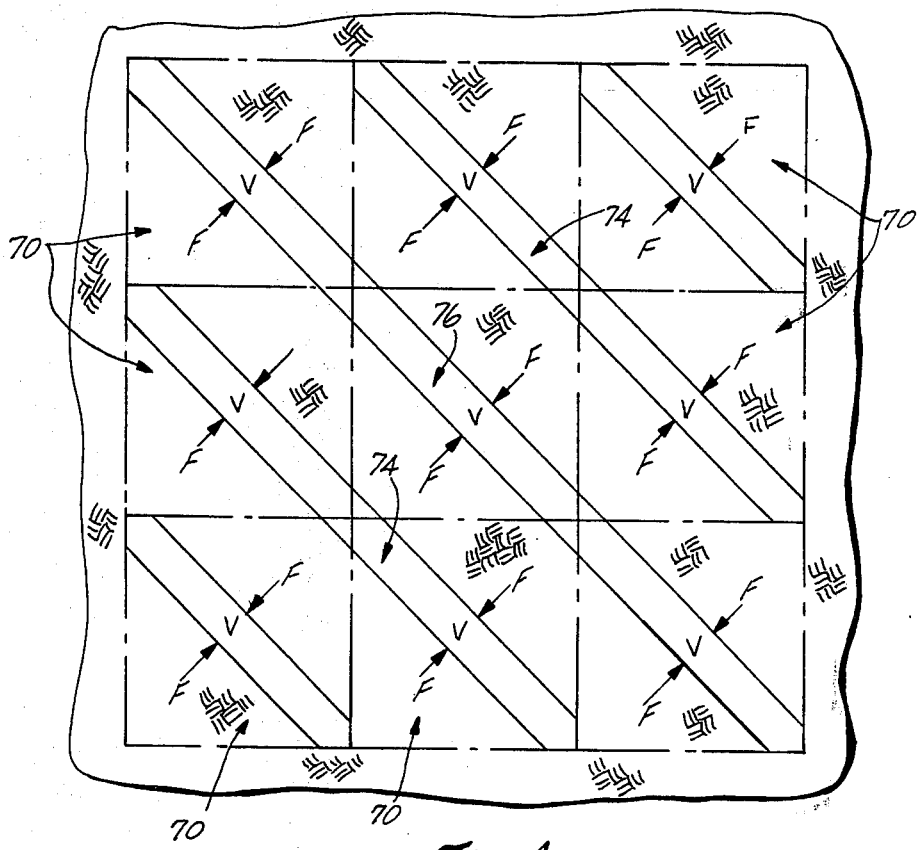
FIG. 4 is a semi-schematic horizontal cross-section showing a retort site with multiple adjacent slots excavated in preparation for explosive expansion according to principles of this invention.
Figure 5:
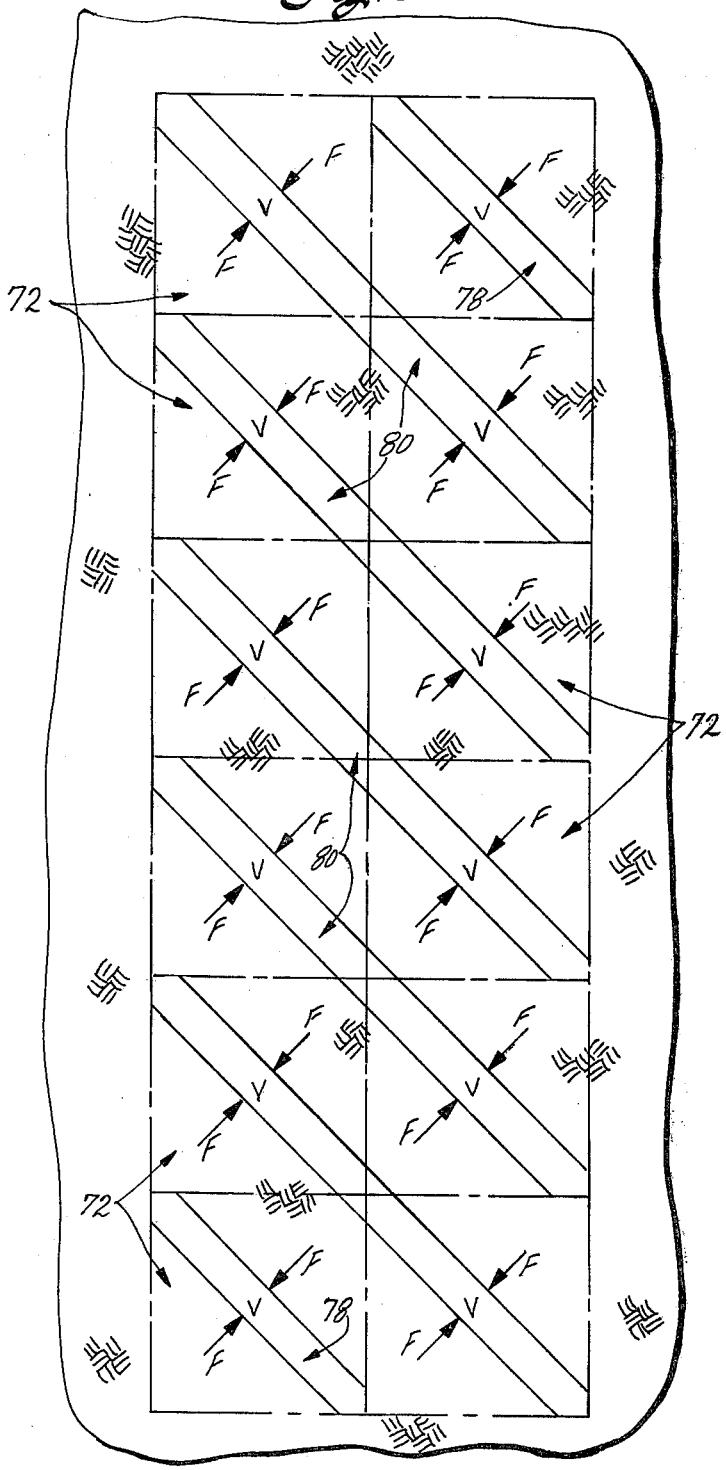
FIG. 5 is a semi-schematic horizontal cross-section showing an alternative arrangement of multiple adjacent slots in an in situ oil shale retort site similar to FIG. 4.

FIGS. 4 and 5 illustrate formation of large cross-sectional retorts using diagonal slot techniques according to principles of this invention. The retort illustrated in FIGS. 1 through 3 can be considered akin to a modular building block in a combination of retorts in which individual retorts or building blocks are positioned adjacent to one another to form a larger retort. The example of FIG. 4 illustrates a system of nine such "retorts" arranged as modular building blocks 70 in a square matrix pattern with three rows of building blocks and three building blocks per row to occupy the entire retort site. In the example of FIG. 5, a system of twelve such building blocks 72 is arranged in a long, narrow, rectangular pattern with two rows of building blocks and six building blocks per row. Each "retort site", or building block, contains a diagonal slot extending between opposite corners of the building block as described above. The triangular zones of formation within the side boundaries of each building block are indicated by the letters F in FIGS. 4 and 5, and the void space within each building block is indicated by the letter V. In each system the diagonal slots formed in diagonally adjacent building blocks are continuous with one another. For example, in the retort system of FIG. 4 there are two such continuous slots 74 each extending across two diagonally adjacent building blocks and a longer continuous diagonal slot 76 is formed along the diagonals of three diagonally adjacent building blocks aligned along a diagonal of the entire retort system. In the retort system shown in FIG. 5, there are relatively shorter diagonal voids 78 extending diagonally across single building blocks at opposite corners of the retort system, and relatively longer continuous diagonal voids 80 each extending across two diagonally adjacent building blocks throughout the remainder of the retort system.

The retort systems using diagonal slots as shown in FIGS. 4 and 5 are especially desirable since large volumes of oil shale formation can be fragmented with an efficient use of explosive along side boundaries of the retort system, while void volume distribution within the system can be reasonably uniform owing to good lateral relief provided for formation expanded in regions of the building block sites farthest from the free faces.

In one embodiment, the retort system of FIG. 4 can contain separate building blocks each about 75 feet long on each side, with the entire retort system being about 225 feet per side. In one exemplary embodiment of the system shown in FIG. 5, building blocks about 75 feet per side can be used for forming an overall retort system having a length of about 450 feet and a width of about 150 feet.

The arrows shown in FIGS. 4 and 5 indicate the direction of movement of formation expanded toward each void for forming portions of a fragmented mass in separate regions of each retort system.

In each retort system shown in the drawings, the length of the diagonal slot can be oriented perpendicular to the major joint system in the formation to maximize slot stability. This is especially desirable for the long continuous slots illustrated in FIGS. 4 and 5. Techniques for so orienting the length of a vertical slot are described in greater detail in application Ser. No. 837,521, filed Sept. 29, 1977, by Irving G. Studebaker and entitled "Method for Forming an In Situ Oil Shale Retort". That application is assigned to the same assignee as this application and is incorporated herein by this reference.

Figure 6:
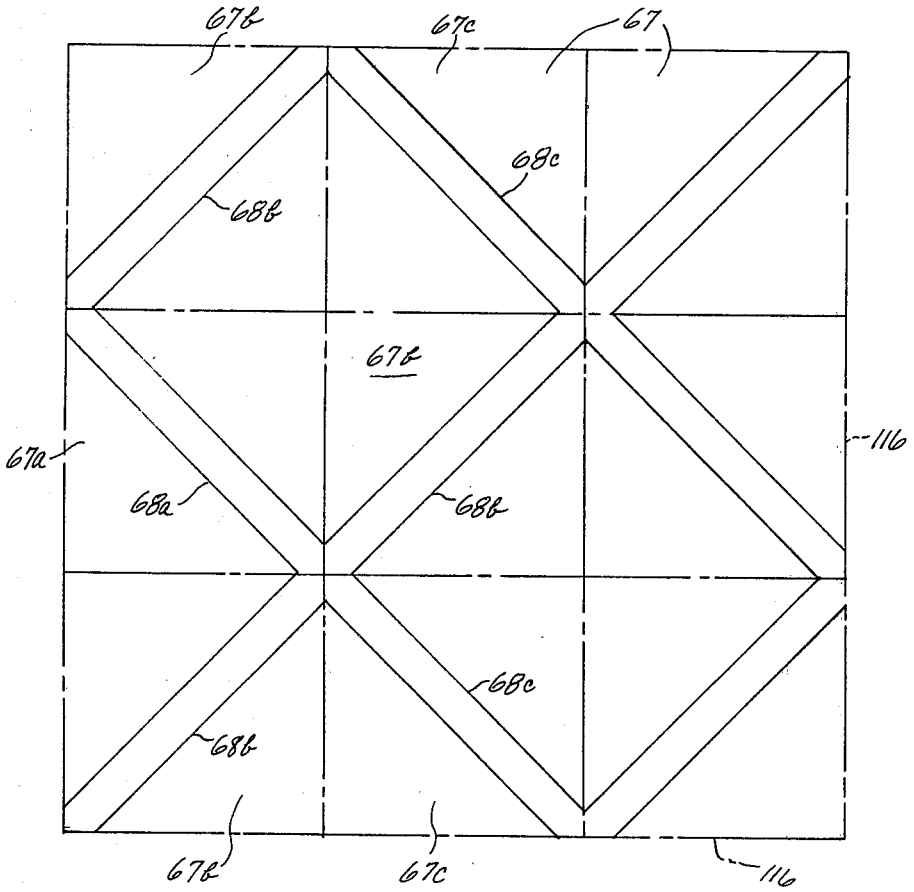
FIG. 6 is a semi-schematic horizongtal cross-section showing an alternative arrangement of modular building blocks each having a diagonal slot for forming a fragmented mass in a retort.

FIG. 6 illustrates another embodiment of retort wherein a large retort is formed using a plurality of modular building blocks containing diagonal slots. As illustrated in this embodiment the retort system has nine modular building blocks 67 in a square matrix pattern with three rows of building blocks and three building blocks per row to occupy the entire retort site within the side boundaries 116.

The diagonal slots 68 in the several building blocks are orthogonal to each other in side-by-side blocks. Thus, in a first modular block 67*a*, there is a diagonal slot 68*a* which can be described as extending northwest and southeast if it is considered that the upper part of the drawing in FIG. 6 is north. In each of the modular building blocks 67*b* having a side common with a side of the building block 67*a*, the diagonal slot 68*b* extends northeast and southwest, that is, the slots 68*b* are orthogonal to the slot 68*a* in the side abutting building block 67*a*. The slots 68*c* in building blocks 67*c* which diagonally abut a corner of the first building block 67*a* are parallel to the slot 68*a* in that first mentioned building block.

These parallel slots in corner abutting building blocks can be either spaced apart or can essentially be continuous depending on which corners of the blocks abut. A similar pattern of slots extends through the remaining building blocks in the site. In the exemplary embodiment illustrated in FIG. 6 the slots in adjacent modular building blocks intersect to form a network of slots skewed 45° from the side boundaries 116 of the retort.

Figure 7:
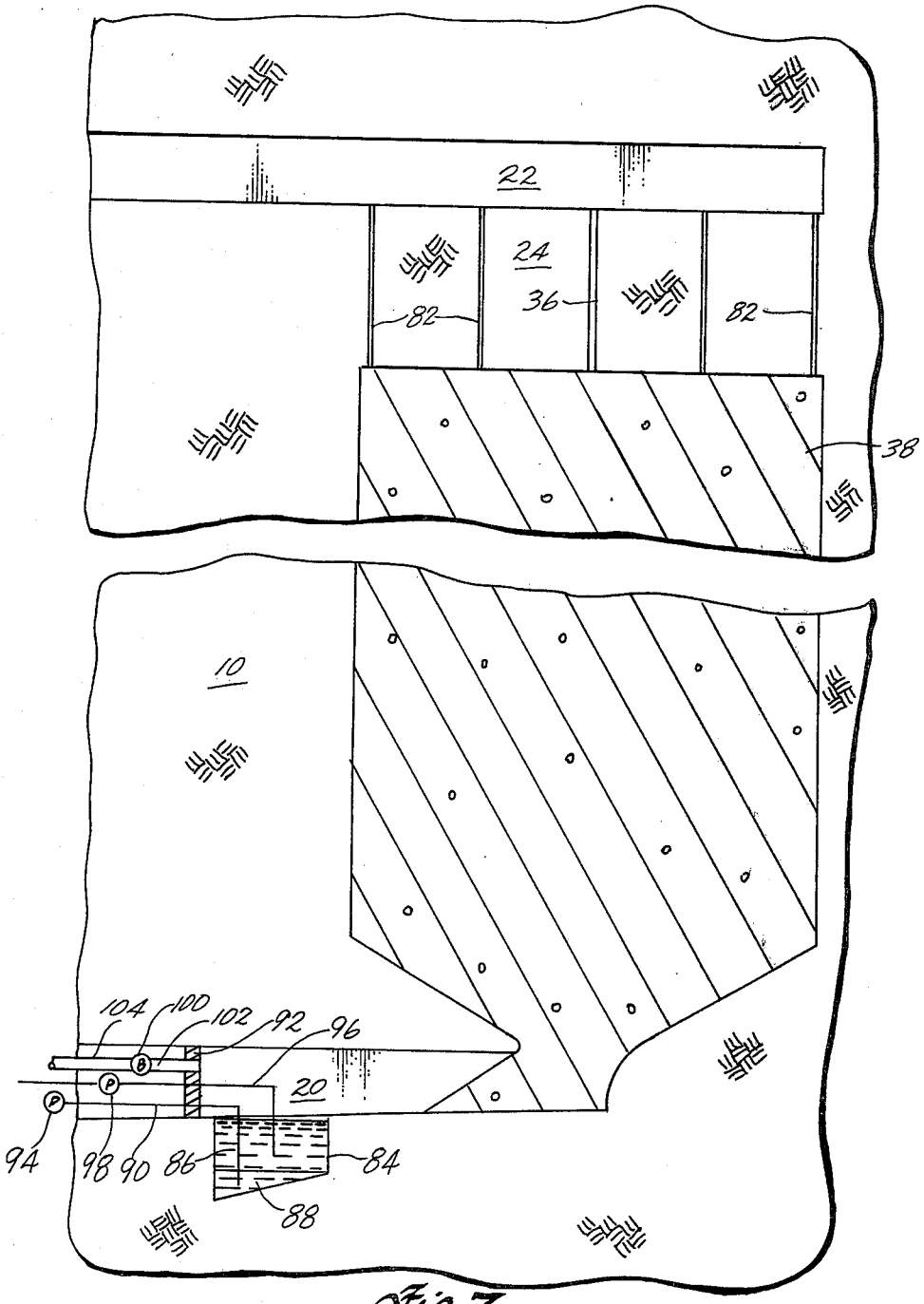
FIG. 7 is a fragmentary, semi-schematic vertical cross-section showing a completed in situ oil shale retort.

FIG. 7 illustrates the retort of FIGS. 1 through 3 in its completed form following explosive expansion for forming the fragmented mass 38. The formation particles at the top of the fragmented mass are ignited to establish a combustion zone at the top of the fragmented mass. Air or other oxygen-supplying gas is supplied to the combustion zone from the base of operation through conduits or passages 82 extending downwardly from the base of operation through the sill pillar to the top of the fragmented mass. The passages can be the upper ends of blasting holes extending through the sill pillar. Air or other oxygen-supplying gas introduced to the fragmented mass through the conduits maintains the combustion zone and advances it downwardly through the fragmented mass. Hot gas from the combustion zone flows through the fragmented mass on the advancing side of the combustion zone to form a retorting zone where kerogen in the fragmented mass is converted to liquid and gaseous products. As the retorting zone moves down through the fragmented mass, liquid and gaseous products are released from the fragmented formation particles. A sump 84 in a portion of the production level drift 20 beyond the fragmented mass collects liquid products, namely, shale oil 86 and water 88 produced during operation of the retort. A water withdrawal line 90 extends from near the bottom of the sump out through a sealed opening in a bulkhead 92 sealed across the drift. The water withdrawal line is connected to a water pump 94. An oil withdrawal line 92 extends from an intermediate level in the sump out through a sealed opening in the bulkhead and is connected to an oil pump 98. The oil and water pumps can be operated manually or by automatic controls to remove shale oil and water separately from the sump. The inlet of a blower is connected by a conduit 102 to an opening through the bulkhead for withdrawing off gas from the retort. The outlet of the blower delivers off gas from the retort through a conduit 104 to a recovery or disposal system (not shown).

What is claimed is:

1. A method for recovering liquid and gaseous products from an in situ oil shale retort formed within a retort site in a subterranean formation containing oil shale, such an in situ oil shale retort containing a fragmented permeable mass of formation particles containing oil shale, such a fragmented mass being formed within side boundaries of a retort site having a generally rectangular horizontal cross-section, the method comprising the steps of:

excavating at least one generally vertical slot-shaped void extending diagonally across the horizontal cross-section of the retort site for forming a pair of substantially parallel, generally vertical free faces of formation adjacent such a void, leaving separate generally triangular-shaped zones of unfragmented formation defined generally by the side boundaries of the retort site adjacent the free faces adjacent the void;

placing explosive in each triangular zone of unfragmented formation and detonating such explosive for explosively expanding each triangular zone of formation toward corresponding free faces adjacent the void for forming a fragmented permeable mass of formation particles containing oil shale in an in situ oil shale retort;

establishing a retorting zone in an upper portion of the fragmented mass and advancing the retorting zone through the fragmented mass for producing liquid and gaseous products of retorting; and withdrawing liquid and gaseous products of retorting from a lower portion of the fragmented mass.

2. The method according to claim 1 in which the void extends diagonally continuously between opposite corners of the side boundaries of the retort being formed.

3. The method according to claim 1 in which the volume of formation excavated from within the retort site forms such a void having a limited void volume relative to the volume of formation explosively expanded toward such void.

4. The method according to claim 3 in which the volume of the excavated void is less than about 35% of the volume of the void plus formation explosively expanded toward the void.

5. The method according to claim 1 in which an array of explosive charges are placed in vertically extending blasting holes in rows generally parallel to such a free face.

6. The method according to claim 5 in which the spacing between explosive charges in each row is substantially equal to the burden distance of such charges.

7. The method according to claim 5 in which the explosive charges in such a row are detonated in a time delay sequence starting nearer the center of the row and progressing in opposite directions along the length of the row towards the side boundaries of the retort.

8. The method according to claim 1 comprising:

excavating a plurality of generally vertical slot shaped voids each extending diagonally across a generally square modular building block of the retort site and leaving within each such modular building block a pair of generally triangular-shaped zones of unfragmented formation adjacent each such void, the modular building blocks occupying the entire retort site, and explosively expanding such remaining zones of unfragmented formation toward such voids for forming the fragmented permeable mass of particles in the retort.

9. A method for forming an in situ oil shale retort in a retort site in a subterranean formation containing oil shale, such as in situ oil shale retort containing a fragmented permeable mass of formation particles containing oil shale formed within generally vertical side boundaries of a retort site having a generally rectangular horizontal cross-section, the method comprising the steps of:

excavating at least one void extending diagonally across the horizontal cross-section of the retort site for forming at least one generally vertical free face adjacent such a void, leaving at least one generally triangular zone of unfragmented formation remaining within the retort site adjacent such a void, said triangular zone being defined generally by side boundaries of the retort site on one side of the diagonal void; and placing explosive in such a triangular zone of formation and detonating such explosive for explosively expanding such a triangular zone of formation toward such a free face for forming a fragmented permeable mass of formation particles containing oil shale within an in situ oil shale retort.

10. The method according to claim 9 in which such a void extends diagonally continuously between opposite corners of the side boundaries of the retort being formed.

11. The method according to claim 9 in which the volume of formation excavated from within the retort site forms such a void having a limited void volume relative to the volume of formation explosively expanded towards such void.

12. The method according to claim 11 in which the volume of the excavated void is in the range of from about 20 to 25% of the volume of the void plus formation explosively expanded toward the void.

13. The method according to claim 9 in which an array of explosive charges are placed in the retort site in vertically extending blasting holes in rows extending generally parallel to such a free face.

14. The method according to claim 13 in which the explosive charges are detonated in a time delay sequence starting nearer the center of such a row and progressing in opposite directions along the length of the row towards side boundaries of the retort.

15. The method according to claim 9 including explosively expanding generally wedge shaped segments of formation from within the triangular zone toward such a vertical free face, wherein at least a portion of such wedge-shaped segments being expanded are generally coextensive with side boundaries of such a triangular zone of formation.

16. A method for explosively expanding oil shale formation toward a limited void volume for forming an in situ oil shale retort within a retort site in a subterranean formation containing oil shale, the retort site being generally rectangular in horizontal cross-section within generally vertical side boundaries of the retort being formed, the retort containing a fragmented permeable mass of formation particles containing oil shale, the method comprising the steps of:

excavating at least one slot-shaped void in formation within the retort site for forming at least one generally vertical free face of formation extending diagonally across the horizontal cross-section of the retort site, leaving at least one generally triangular-shaped zone of formation defined generally by the side boundaries of the retort site adjacent such a vertical free face;

drilling a plurality of mutually spaced apart generally vertical blasting holes in such a triangular zone of formation;

placing explosive in such blasting holes; and detonating such explosive in a single round of explosions for explosively expanding such a triangular zone of formation toward such a vertical free face for forming a fragmented permeable mass of formation particles containing oil shale in an in situ oil shale retort.

17. The method according to claim 16 in which at least one row of such blasting holes extends generally parallel to such a vertical free face.

18. The method according to claim 17 including detonating explosive in such blasting holes in a time delay sequence starting near the center of such a row and progressing toward opposite ends of such a row.

19. The method according to claim 16 including detonating explosive in such blasting holes in a time delay sequence progressing away from such a vertical free face toward a corner of the retort site farthest from the free face.

20. The method according to claim 16 in which detonation of explosive in such blasting holes explosively expands generally wedge-shaped segments of formation toward the free face, at least a portion of such wedge-shaped segments conforming generally to side boundaries of such triangular zone of formation.

21. The method according to claim 16 comprising:

excavating a plurality of generally vertical slot shaped voids each extending diagonally across a generally square modular building block of the retort site and leaving within each such modular building block a pair of generally triangular-shaped zones of unfragmented formation adjacent each such void, the modular building blocks occupying the entire retort site, and explosively expanding such remaining zones of unfragmented formation toward such voids for forming the fragmented permeable mass of particles in the retort.

22. In a method for forming an in situ oil shale retort in a retort site in a subterranean formation containing oil shale, the retort containing a fragmented permeable mass of formation particles containing oil shale, wherein the fragmented mass is formed within side boundaries of a retort site having generally rectangular horizontal cross-sectional configuration, the improvement comprising the steps of:

placing an array of vertically extending columnar explosive charges in a zone unfragmented formation within the retort site, the array of explosive charges being distributed across the horizontal cross-section of the retort site; and detonating such explosive charges for explosively expanding separate generally wedge-shaped segments of formation from within said zone of formation toward a generally slot-shaped void having a generally vertical free face extending diagonally across the horizontal cross-section of the retort site, for expanding toward such a free face a generally triangular-shaped zone of formation defined by the side boundaries of the retort site on one side of the diagonal free face for forming a fragmented permeable mass of formation particles containing oil shale within the retort site.

23. The improvement according to claim 22 wherein expansion of formation within the retort site is toward a limited void volume.

24. The improvement according to claim 23 in which the explosive charges are placed in at least one row extending generally parallel to such a vertical free face.

25. The improvement according to claim 22 in which expansion of at least a portion of such wedge-shaped segments of formation conforms generally to side boundaries of the zone of formation.

26. A method for forming an in situ oil shale retort within vertical side boundaries of a retort site in a subterranean formation containing oil shale, the retort containing a fragmented permeable mass of formation particles containing oil shale, the method comprising the steps of:

placing an array of explosive charges in a generally triangular-shaped zone of unfragmented formation bounded on two sides by side boundaries of the retort being formed and bounded on the third side by a generally vertical free face of formation adjacent a void excavated in formation within the retort site; and detonating the array of explosive charges for explosively expanding the generally triangular-shaped zone of formation toward the vertical free face for forming a fragmented permeable mass of formation particles containing oil shale in an in situ oil shale retort.

27. The method according to claim 26 in which the explosive charges are columnar and extend parallel to the vertical free face and generally wedge-shaped segments of formation are expanded toward the free face upon detonation of such explosive charges.

28. The method according to claim 26 in which such explosive charges are placed in at least one row extending generally parallel to the free face.

29. The method according to claim 26 in which formation is expanded from the triangular zone toward a limited void volume.

30. The method according to claim 26 in which at least a portion of the wedge-shaped segments of formation conform generally to the side boundaries of the triangular zone.

31. The method according to claim 26 in which the explosive charges are placed in at least one row adjacent the void and the spacing between explosive charges in such a row is substantially equal to the burden distance of such explosive charges.

32. A method for forming an in situ oil shale retort in a subterranean formation containing oil shale, the retort being formed within side boundaries of a retort site having a generally rectangular horizontal cross-section and from a plurality of adjacent modular building blocks, the method comprising the steps of:

excavating formation from within at least a pair of diagonally adjacent building blocks within side boundaries of the retort site for forming an elongated, generally vertical slot-shaped void extending diagonally across the horizontal cross-sections of such adjacent building blocks for forming a generally vertical free face of formation within each building block adjacent the void, leaving separate generally triangular-shaped zones of unfragmented formation defined by each building block adjacent a respective portion of the diagonal void; and placing explosive in each triangular-shaped zone of formation and detonating such explosive for explosively expanding the triangular zones of formation toward respective portions of the slot-shaped void for forming a fragmented permeable mass of formation particles containing oil shale within each of the adjacent building blocks.

33. The method according to claim 32 wherein the length of the void extends generally perpendicular to a major joint system in the subterranean formation.

34. A method for forming an in situ oil shale retort within a retort side in a subterranean formation containing oil shale, such as in situ oil shale retort containing a fragmented permeable mass of formation particles containing oil shale, comprising the steps of:

excavating a void in such formation for forming a generally vertical free face of formation adjacent such a void;

placing an array of explosive charges in a first generally triangular-shaped zone of formation adjacent a first free face;

placing an array of explosive charges in a second generally triangular-shaped zone of formation adjacent a second free face adjacent the first free face; and detonating such explosive charges in the first triangular zone for explosively expanding the first triangular zone toward the first free face, and detonating such explosive charges in the second triangular zone for explosively expanding the second triangular zone toward the second free face for forming a fragmented permeable mass of formation particles containing oil shale in an in situ oil shale retort.

35. The method according to claim 34 in which the first and second free faces are continuous.

36. The method according to claim 34 wherein the void comprises a generally vertically extending slot-shaped void and further comprising:

placing an array of explosive charges in a third generally triangular-shaped zone of formation on the opposite side of the void from the first triangular-shaped zone;

placing an array of explosive charges in a fourth generally triangular-shaped zone of formation on the opposite side of the slot-shaped void from the second triangular-shaped zone; and detonating such explosive charges in the third and fourth triangular zones for explosively expanding the third and fourth zones toward the slot-shaped void at substantially the same time as explosive expansion of the first and second zones.

37. The method according to claim 34 in which the first and second free faces are generally orthogonal to each other.

38. A method for forming an in situ oil shale retort in a retort site in a subterranean formation containing oil shale, the retort containing a fragmented permeable mass of formation particles containing oil shale and having generally vertical side boundaries, the method comprising the steps of:

excavating a vertically extending slot-shaped void forming at least one generally vertical free face and leaving at least one zone of unfragmented formation adjacent such a free face within the side boundaries of the retort site;

forming an array of vertical blasting holes in such a zone of unfragmented formation;

placing charges of explosive in such an array of blasting holes; and detonating such explosive charges in such an array of blasting holes for explosively expanding the zone of formation toward such a free face, the width of the zone of formation expanded toward the free face becoming progressively narrower away from the free face.

39. The method according to claim 38 wherein at least a portion of the blasting holes are in rows extending generally parallel to such a free face and the number of blasting holes in each row progressively decreases away from the free face.

40. A method for forming an in situ oil shale retort in a subterranean formation containing oil shale, the retort containing a fragmented permeable mass of formation particles containing oil shale and having generally vertical side boundaries and a generally rectangular horizontal cross-section, the fragmented mass being formed in a plurality of adjacent generally rectangular modular building blocks, comprising the steps of:

excavating a vertically extending void in each such modular building block, each such void extending diagonally across such a building block and leaving a pair of generally triangular zones of unfragmented formation defined by formation within such building block on opposite sides of such void; and explosively expanding each such triangular zone of formation towards such a void for forming a fragmented permeable mass of formation particles in each such modular building block.

41. A method for forming an in situ oil shale retort in a retort site in a subterranean formation containing oil shale, the retort containing a fragmented permeable mass of formation particles containing oil shale and having generally vertical side boundaries, comprising the steps of:

excavating a vertically extending slot-shaped void forming at least one generally vertical free face and leaving at least one zone of unfragmented formation adjacent such a free face within the side boundaries of the retort site;

forming a plurality of mutually spaced apart vertical blasting holes in such a zone of unfragmented formation, wherein at least a portion of the blasting holes are in rows extending generally parallel to such a free face;

placing columnar charges of explosive in such blasting holes; and detonating such explosive for explosively expanding formation toward such a free face, wherein the width of the zone of formation expanded toward the free face becomes progressively narrower away from the free face, and the number of blasting holes in each row progressively decreases away from the free face.

42. A method for forming an in situ oil shale retort in a retort site in a subterranean formation containing oil shale, the retort containing a fragmented permeable mass of formation particles containing oil shale and having generally vertical side boundaries, comprising the steps of:

excavating a generally vertically extending slot-shaped void forming at least one vertical free face of formation within the retort site;

placing an array of explosive charges in a generally triangular-shaped pattern adjacent the free face, wherein the free face defines one side of the triangle and the explosive charges are placed in a pattern that generally decreases in width away from the free face; and detonating the triangular pattern of explosive charges for explosively expanding formation within the retort site toward the free face such the progressively less and less formation is expanded toward the free face in a direction away from the free face.

* * * * *

UNITED STATES PATENT AND TRADEMARK OFFICE

CERTIFICATE OF CORRECTION

PATENT NO. : 4,262,965

DATED : April 21, 1981

INVENTOR(S) : Thomas E. Ricketts

It is certified that error appears in the above—identified patent and that said Letters Patent is hereby corrected as shown below:

Column 4, line 7, "horizongtal" should be -- horizontal --.
Column 5, line 46, "In" should be -- in --.
Column 6, line 33, "of the lower" should be -- to the lower --;
Column 6, line 51, "hole" should be -- holes --.
Column 7, line 68, "in" should be -- is --.
Column 8, line 44, "dur" should be -- due --.
Column 9, line 59, "A13.5" should be -- 13.5 --.
Column 13, line 48, "as" should be -- an --.
Column 15, line 29, -- of -- should be inserted after "zone" and before "unfragmented".
Column 16, line 57, "side" should be -- site --.
Column 18, line 58, "the" should be -- that --.

Signed and Sealed this

First Day of September 1981

[SEAL]

Attest:

GERALD J. MOSSINGHOFF

Attesting Officer

Commissioner of Patents and Trademarks